US005635253A

United States Patent [19]

Canaperi et al.

[11] Patent Number: 5,635,253

[45] Date of Patent: Jun. 3, 1997

[54] METHOD OF REPLENISHING ELECTROLESS GOLD PLATING BATHS

[75] Inventors: Donald F. Canaperi, Bridgewater, Conn.; Rangarajan Jagannathan, Patterson; Mahadevaiyer Krishnan, Hopewell Junction, both of N.Y.

[73] Assignee: International Business Machines Corporation, Yorktown Heights, N.Y.

[21] Appl. No.: 487,808

[22] Filed: Jun. 7, 1995

Related U.S. Application Data

[63] Continuation of Ser. No. 297,998, Aug. 30, 1994, abandoned.

[51] Int. Cl.[6] ..... B32B 17/10

[52] U.S. Cl. ..... 427/437; 427/443.1

[58] Field of Search ..... 427/437, 443.1

[56] References Cited

U.S. PATENT DOCUMENTS

| | | | |
|---|---|---|---|
| 3,589,916 | 6/1971 | McCormack | 106/1 |
| 4,142,902 | 3/1979 | Burke et al. | 106/1.23 |
| 4,337,091 | 6/1982 | El-Shazly et al. | 106/1.23 |
| 5,130,168 | 7/1992 | Mathe et al. | 427/443.1 |
| 5,258,062 | 11/1993 | Nakazawo et al. | 106/1.23 |

OTHER PUBLICATIONS

D. Mahulikar, A. Pasqualoni, J. Crane, and J. Braden, "Development of a Cost Effective High Performance Metal QFP Packaging System," in Proceedings of the IEEE International Symposium on Microelectronics, pp. 405–410 (1993).

M. Nakazawa and S. Wakabayashi, "Ceramic Packages and Substrates prepared by Electroless Ni–Au Process," in Proceedings of the IEEE/CHMT Symposium, pp. 366–370 (1991).

B. Hassler, "Confired Metallized Ceramic Technology and Fabrication Using Electroless Plating," in Proceedings of the International Symposium on Microelectronics, pp. 741–748 (1986).

T. Goodman, H. Fujita, Y. Murakami, and A. Murphy, "High Speed Electrical Characterization and Simulation of Pin Grid Array Package," in Proceedings of the IEEE/CHMT Japan International Electronics Manufacturing Technology Symposium, pp. 303–307 (1993).

G. Ganu and S. Mahapatra, "Electroless Gold Deposition for Electronic Industry," in Journal of Sci. & Ind. Res., vol. 46, pp. 154–161 (1987).

H. Ali and I. Christie, "A Review of Electroless Gold Deposition Processes," in Gold Bull., vol. 17, pp. 118–127 (1984).

Y. Okinaka and C. Wolowodiuk, "Electroless Gold Deposition: Replenishment of Bath Constituents," in Plating, vol. 58, pp. 1080–1084 (1971).

F. Simon, "Deposition of Gold Without External Current Source," in Gold Bulletin, vol. 26, pp. 14–26 (1993).

*Primary Examiner*—Benjamin Utech
*Attorney, Agent, or Firm*—Ratner & Prestia

[57] ABSTRACT

A replenishing solution for a cyanide-based electroless gold plating bath. The solution includes a gold(III) halide such as gold chloride, gold bromide, tetrachloroaurate (and its sodium, potassium, and ammonium salts), and tetrabromoaurate (and its sodium, potassium, and ammonium salts). The replenishing solution also may include an alkali (such as potassium hydroxide, sodium hydroxide, and ammonium hydroxide) to maintain the pH of the solution between 8 and 14. Also provided is a method of replenishing a cyanide-based electroless gold plating bath with the solution of the present invention.

16 Claims, 2 Drawing Sheets

METHOD OF REPLENISHING ELECTROLESS GOLD PLATING BATHS

This application is a continuation of application Ser. No. 08/297,998 filed Aug. 30, 1994, now abandoned.

FIELD OF THE INVENTION

This invention relates generally to a solution for and a method of replenishing electroless gold plating baths and, more particularly, to a solution using gold halide-hydroxide chemistry for replenishing cyanide-based electroless gold plating baths and a method of replenishing such baths which incorporates that solution.

BACKGROUND OF THE INVENTION

The electronics industry has grown rapidly through technological advance and the current trend is toward miniaturization of circuits. For the emerging, high-speed, high-power devices such as microprocessors, ASIC's, and signal processors, packaging is a crucial issue. Such applications often require 2 to 10 watt power dissipation and speeds exceeding 100 MHz. Accordingly, many high-performance, low-cost package design options have been investigated. See, e.g., D. Mahulikar, A. Pasqualoni, J. Crane, and J. Braden, "Development of a Cost Effective High Performance Metal QFP Packaging System," in Proceedings of the IEEE International Symposium on Microelectronics, pp. 405–10 (1993).

Various design applications have required the use of gold in circuit fabrication. Gold resists corrosion, is chemically inert, is electrically and thermally conductive, and has a low ohmic contact resistance. This unique combination of properties allows gold to give circuits high efficiency by varying signals to and from various components and component arrays even when applied as a thin film (3–5 μm thick). Consequently, gold is often deposited or coated on circuit lines and on different electronic components.

Gold can be deposited by various methods. To deposit gold from a solution containing metal salt, negative electrical charges are provided to convert the positively charged gold ion (by reduction) into the zero-valent state or the metallic form. In the usual case of electrolytic gold deposition, an external source of current provides the necessary charges for reduction at the cathode.

Alternative deposition methods do not depend on an external source of current. The charges required for deposition in these methods are supplied either by charge exchange reactions or are derived from chemical reducing agents. In charge exchange methods, a relatively less noble metal (usually the basis material) dissolves and the more noble gold ion in the solution is reduced and deposited on the substrate. Such methods are referred to as immersion or displacement deposition (or plating) processes.

In the case of chemical reduction methods, on the other hand, a suitable chemical compound (a reducing agent) supplies the necessary negative charges. The reducing agent is oxidized at the same time. Such methods are referred to as autocatalytic or electroless deposition methods.

Electroless gold deposition methods have become increasingly important in providing suitable metallurgy for electronic packaging applications. Such applications include contact areas, bonding surfaces on chip carriers (particularly ceramics), parts with glass-insulated bushings, transistor parts, cases, and many others. Electroless gold deposition methods play a critical role in simplifying the methodology of manufacturing ceramic-and polymer-based chip carriers, such as cavity pin grid arrays and surface mounted packages, and in enhancing design flexibility. See., e.g., M. Nakazawa and S. Wakabayashi, "Ceramic Packages and Substrates Prepared by Electroless Ni—Au Process," in Proceedings of the IEEE/CHMT Symposium, pp. 366–70 (1991).

The key challenge in cost and performance packaging technology is to provide high density multilayer interconnection capability with smaller wire bond pad spacing and conductor widths while retaining the design flexibility to achieve low impedance to output pins. Electroless gold plating technology offers unique advantages for the metallization of such structures.

Electrolytic plating requires extra circuit lines to connect pads together from layer to layer for connection to a tie (or bus or plating) bar. Often, after lamination, edge metallization is applied to the part so that, after firing, the part may be clipped onto the plating rack fixture for electrical contact. The plating rack is hung on a cathode bar for plating. The extra circuit lines and edge metallization can cause several problems. Extra circuit lines complicate circuit layout and cause cross-talk problems. Edge metallization must be removed by grinding or breaking. In addition, the different circuit line distances to the pad being plated cause plating thickness variations. Each pad will have a different electrical resistance from it to the tie bar and, because electrolytic plating thickness depends on current, the plating thickness will vary. Electrolytic barrel plating is used to avoid tie bars and shorting the circuit; parts are subject, however, to chipping and other damage in the barrel.

Electroless plating circumvents these problems with the electrolytic method. Because it does not require the ceramic circuitry to be shorted for electrical connection, unlike electrolytic plating, electroless plating does not require the entire metallized ceramic circuit to be shorted together and connected to a cathode with an electric current applied from an outside source to plate parts. Nor is it necessary to have extra conductor lines routed to the edge of the substrate. The electroless plating method is self-initiating upon placing the parts into a plating bath without having to apply an electric current.

Electroless plating eliminates plating bars, resulting in simplified circuit layout and reduced layout time; significantly reduces cross-talk due to extraneous plating conductors and circuitry; eliminates costly (and sometimes damaging) grinding and finishing operations to remove plating tie bars; provides improved gold plate thickness control on solder pads, wire bond fingers, and brazed components; and provides unique design opportunities for package configuration. B. Hassler, "Cofired Metallized Ceramic Technology and Fabrication Using Electroless Plating," in Proceedings of the International Symposium on Microelectronics pp. 741–48 (1986). Design flexibility and simplification of the circuit layout are critical factors in enhancing the performance of packaging modules.

Ceramic/polymer packaging modules with cavity die attach and gold wire bonding with pin grid arrays or surface mounted lead frames have become increasingly popular as single chip carriers for the I-486 and Power PC family of microprocessors. See, e.g., T. Goodman, H. Fujita, Y. Murakami, and A. Murphy, "High Speed Electrical Characterization and Simulation of Pin Grid Array Package," in Proceedings of the IEEE/CHMT Japan International Electronics Manufacturing Technology Symposium, pp. 303–07 (1993); D. Mahulikar, A. Pasqualoni, J. Crane, and J. Braden, supra. Molybdenum or tungsten is widely used within the alumina substrate as a conductor while copper is the metal of choice for polymer based chip carriers. The pad/pin assembly (Kovar/Cu—Ag or Ag) must be protected from corrosion and wet electro-migration by Ni/Au or Ni—Co/Au over-layers. (Kovar is an iron-nickel-cobalt alloy with a density of 8.3 g/cc, a thermal expansion coefficient (20°–500° C.) of 5.7 to $6.2\times10^{-6}$, a thermal conductivity of 0.04 cal/cm-sec-°C., and a specific electrical resistance of $50\times10^{-6}$ ohm-cm.)

For pluggable pins, up to 10 μm of heavy soft gold metallurgy is preferred. The wire bond pads and the cavity die attach areas are also plated with gold to provide suitable metallurgy for gold-silicon or JM 7000 epoxy die attach and gold or aluminum wire bonding. The gold should be 99.99% pure and conform to MIL SPEC 4520-C. Electroless gold plating processes using amineborane or borohydride as the reducing agent provide gold deposits of excellent quality able to satisfy these requirements.

In view of their advantages, a large number of electroless gold plating bath formulations are disclosed in the literature. See G. Ganu and S. Mahapatra, "Electroless Gold Deposition for Electronic Industry," in Journal of Sci. & Ind. Res., Vol. 46, pp. 154–61 (1987), and H. All and I. Christie, "A Review of Electroless Gold Deposition Processes," in Gold Bull., Vol. 17, pp. 118–27 (1984), for listings of various combinations of gold complexes and reducing agents which have been tested as potential electroless gold plating baths.

The electroless gold plating baths described in the literature, which use amineborane or borohydride as the reducing agent, contain gold in a cyanide complex with excess free cyanide as the stabilizer. The baths normally operate in the pH range of 12–14 and potassium hydroxide (KOH) is used to maintain the alkalinity. The typical deposition rate of these baths is about 0.5 μm/hour. Lead or thallium is used to enhance the rate to about 2 μm/hour. Both lead and thallium influence the quality of the gold metallurgy, however, and their concentrations must be kept very low (typically below 100 ppm) to avoid any adverse effect on bonadability. The concentrations of free cyanide and the lead or thallium are carefully optimized to provide adequate stability, good plating rate, and excellent metallurgy.

As plating progresses, the cyanide ion is continuously released and, with increasing free cyanide concentration in the bath, the plating rate drops considerably. Usually the plating solution is discarded (after about 4–5 hours) when the rate drops below 1 μm/hour. Only about 25 to 35% of the gold content of the bath is used for plating. Thus, continuous bath operation for several hours is not possible. Furthermore, high volume production requires frequent new bath make-up and waste disposal—both of which increase the cost of processing.

The useful life of the electroless gold plating baths can be extended by replenishing the constituents of the bath. Replenishment procedures involving gold cyanide (AuCN) and potassium aurocyanide ($KAu(CN)_2$) have been attempted. See, e.g., Y. Okinaka and C. Wolowodiuk, "Electroless Gold Deposition: Replenishment of Bath Constituents," in Plating, Vol. 58, pp. 1080–84 (1971); F. Simon, "Deposition of Gold Without External Current Source," in Gold Bulletin, Vol. 26, pp. 14–26 (1993). Addition of gold cyanide resulted in excessive precipitation of gold particles, however, and bath decomposition after only a few hours of operation.

Moreover, to overcome the drop in the plating rate and to keep it around 2 μm/hour, the concentration of rate enhancer must be steadily increased. Because rate enhancers affect the metallurgy of the deposition at higher concentrations, such replenishing solutions have very limited application in high volume manufacturing. The challenge remains, therefore, to develop a replenishing solution that will supply gold ions without increasing the free cyanide concentration in the bath. Such a procedure should not adversely affect the bath stability, plating rate, or the quality of the deposit metallurgy.

In summary, the literature discloses that no electroless gold plating bath has been established that is suitable for continuous production. See G. Ganu and S. Mahapatra, supra. Although some processes can be used on small scale applications with consistent success, the conventional electroless gold plating baths suffer from low deposition rates (about 1.5 μm/hr), poor selectivity for conductor patterns and ceramics, short working lives, instability (mainly caused by nickel contamination), and poor adhesion to electroless nickel. See M. Nakazawa and S. Wakabayashi, supra. There remains a need, therefore, for a reliable electroless gold plating bath for wide-spread applications.

To overcome the shortcomings of such conventional baths, a new replenishing solution for a cyanide-based electroless gold deposition bath is provided. An object of the present invention is to provide an improved bath with increased stability. A related object is to assure relatively low self-decomposition of the reducing agent. Another object is to provide a bath able to deposit gold rapidly with a constantly maintainable deposition rate.

It is still another object of the present invention to reduce the tendency toward random deposition and increase the reproducibility of results (bath and deposit properties). An additional object is to provide a bath with long life (metal turnover) enabling repeated use of the bath chemistry while requiring simple maintenance. This will yield cost savings because the chemicals used to make up the bath can be conserved. In addition, chemical waste treatment and disposal of the cyanide solutions generated by the method of plating are reduced, thereby enhancing the price-performance factor for the electroless gold plating process. Yet another object of this invention is to provide a bath which has a low sensitivity to metallic contaminants (particularly nickel and tin ions).

SUMMARY OF THE INVENTION

To achieve these and other objects, and in view of its purposes, the present invention provides a replenishing solution for a cyanide-based electroless gold plating bath. The solution includes a gold(III) halide such as gold chloride, gold bromide, tetrachloroaurate (and its sodium, potassium, and ammonium salts), and tetrabromoaurate (and its sodium, potassium, and ammonium salts). The replenishing solution also may include an alkali (such as potassium hydroxide, sodium hydroxide, and ammonium hydroxide) to maintain the pH of the solution between 8 and 14, an amine borane reducing agent, or both.

Also provided is a method of replenishing a cyanide-based electroless gold plating bath with the solution of the present invention. The method includes the following steps: (1) providing a cyanide-based electroless gold plating bath having a source of gold including cyanide, a reducing agent, a stabilizer, and a pH adjuster which maintains the pH of the bath between 11 and 14; (2) depositing gold on a substrate using the bath, thereby removing gold from the bath; (3) providing a replenishing solution which includes a gold(III) halide and an alkali to maintain the replenishing solution at a pH between 8 and 14; (4) determining the amount of gold removed from the bath; and (5) adding a sufficient amount of the replenishing solution to the bath to replace the gold removed from the bath during the depositing step without increasing the free cyanide concentration level in the bath above the initial level in the bath.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which.

DETAILED DESCRIPTION OF THE INVENTION

Figure 1:
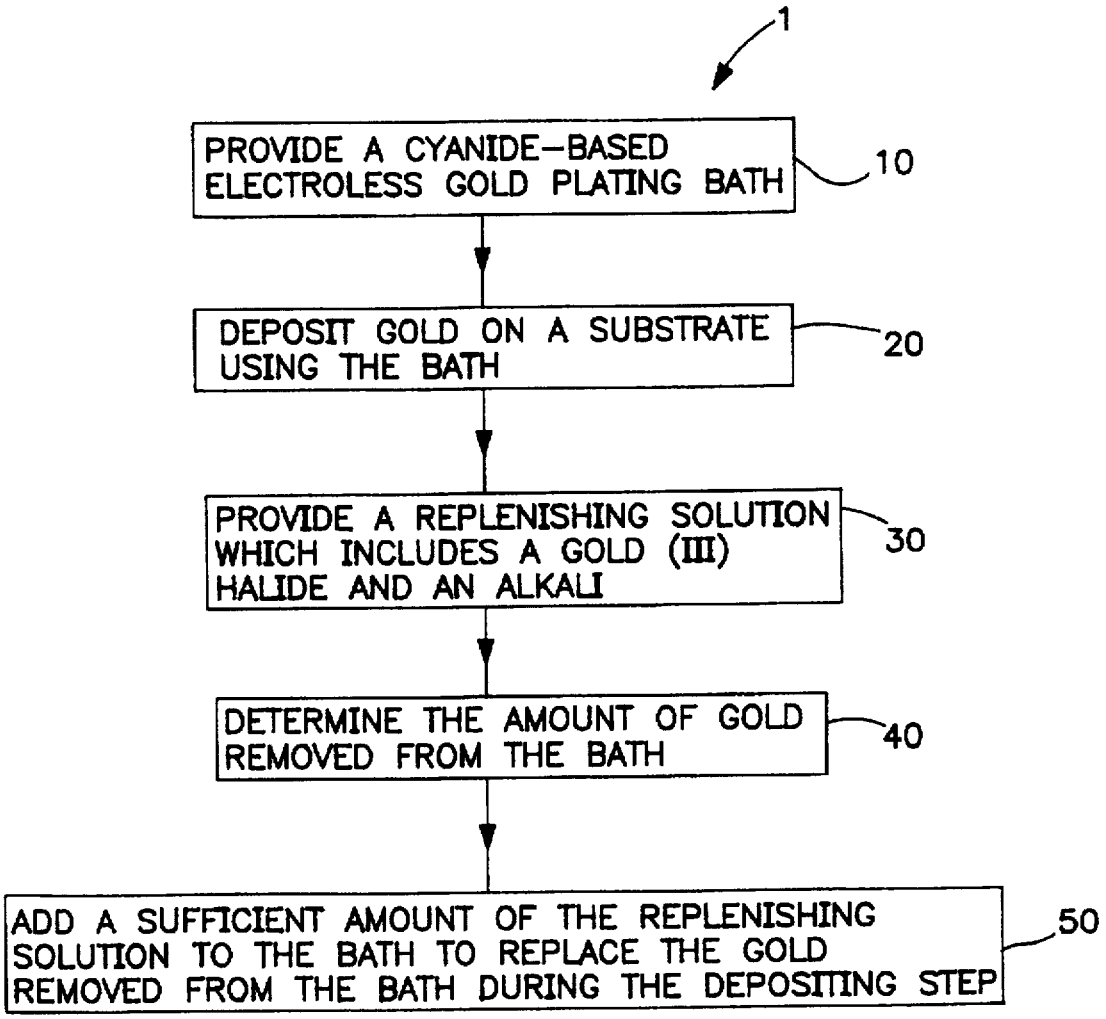
FIG. 1 is a flow chart illustrating the method of the present invention.

Generally, electroless gold plating baths include gold source compounds, reducing agents, chelating agents, buffer solutions, exaltants (or accelerators), stabilizers, and wetting agents. A variety of bath formulations can be found in the literature. See, e.g., F. Simon, Supra; G. Ganu and S. Mahapatra, supra; and H. Ali and I. Christie, supra. Different compounds have been selected as the source of metallic gold, including potassium aurocyanide ($KAu(CN)_2$), gold cyanide (AuCN), potassium tetracyanoaurate ($KAu(CN)_4$), and hydrogen tetrachloroaurate ($HAuCl_4$), among others. Various reducing agents such as sodium hypophosphite, hydrazine, hydroxylamine, N,N-diethylglycine, formaldehyde, $NaBH_4$, and dimethylaminoborane (DMAB) have been used to reduce gold ions to gold metal via in situ generation of hydride ions.

Chelating agents act as a buffer and prevent rapid decomposition of the bath. Example chelating agents include citric acid, tartaric acid, salts of hydroxy carboxylic acids (potassium citrate, potassium tartarate, ethylenediaminetetraacetic acid (EDTA), and the like), and amines (triethanolamine, ethanolamine, ethylenediamine, and the like). Stabilizers such as thiourea, alkali metal cyanide, alkali hydrogen fluoride, acetyl acetone, and sodium ethyloxanthate inhibit the solution from decomposing by masking active nuclei. Exaltants or accelerators such as succinic acid, lead, and thallium counteract the slowing effect of the chelating agent. The pH ranges from very alkaline (e.g., 13.7) in some baths to very acidic (e.g., pH less than one) in other formulations. Buffers such as alkali metal salts (e.g., phosphate, citrate, tartarate, borate, metaborate, and their mixtures) maintain the pH of the solution. Finally, wetting agents such as sulphonates of fatty acids and sulphonated alcohols promote wetting by the solution of substrates to be plated.

Formulations based on the use of potassium aurocyanide ($KAu(CN)_2$) as the source of gold and DMAB ($(CH_3)_2NH\times BH_3$) as the reducing agent have been examined most extensively and probably have been the most successful in practice. The base electrolyte consists of potassium cyanide and potassium hydroxide. Knowledge of these types of baths is essentially based on the work of Y. Okinaka and his colleagues. See, e.g., Y. Okinaka and C. Wolowodiuk, supra. The bath is alkaline, primarily because borohydride undergoes hydrolysis in acid media according to the reaction: $BH_4^-+2H_2O\rightarrow BO_2^-+4H_2$. Thus, the pH is maintained as high as possible using potassium hydroxide. The components of the bath are summarized in the table below.

Composition of Electroless Gold Plating Bath

| Component | Amount |
|---|---|
| Potassium aurocyanide, $KAu(CN)_2$ | 1 to 15 g/l |
| DMAB, $(CH_3)_2NH\times BH_3$ | 1 to 20 g/l |
| Potassium cyanide, KCN | 1 to 20 g/l |
| Potassium hydroxide, KOH | 10 to 100 g/l |
| Amines | 10 to 200 g/l |
| Lead | 0.1 to 100 ppm |

In autocatalytic electroless deposition generally, a catalytic substrate is immersed in the plating solution whereupon reactions begin simultaneously and metal is deposited only on the substrate surface (heterogeneous). The deposited metal catalyzes the reaction, causing it to continue autocatalytically. The two most essential components of the plating bath are the metal ions, $M^{n+}$, and the reducing agent, R. The plating reaction can be described as follows: $M^{n+}+R\rightarrow M^0+R^+$. The oxidation-reduction reaction occurs at the surface of the metal (or metallized) substrate. There, the metal ions $M^{n+}$ accept electrons from the reducing agent and deposit metal film $M^0$. The reducing agent, having donated its electrons, is converted to its oxidized form $R^+$. Thus, the above equation can be considered to be a summation of two partial oxidation-reduction reactions: $M^{n+}+ne^-\rightarrow M^0$ (reduction of metal ions) and $R-ne^-\rightarrow R^+$ (oxidation of the reducing agent).

Turning to the specific reactions for the electroless gold plating bath which uses potassium aurocyanide as the source of gold and DMAB as the reducing agent, the $BH_3OH^-$ ion is the actual reducing agent. That ion is formed in a preliminary reaction: $(CH_3)_2NH\times BH_3+OH^-\rightarrow(CH_3)_2NH+BH_3OH^-$. Thus, the amine (dimethylamine) attached to the $BH_3$ molecule must be displaced by an $OH^-$ ion to generate $BH_3OH^-$ ions. This displacement reaction is favored in the alkaline pH range where $OH^-$ ions are abundant.

The plating reaction can be described as follows: $(CH_3)_2NH\times BH_3+4OH^-+3Au(CN)_2^-\rightarrow(CH_3)_2NH+BO_2^-+3/2H_2+2H_2O+3Au+6CN^-$. That equation can be considered to be a summation of two partial oxidation-reduction reactions: (1) $3Au(CN)_2^-+3e\rightarrow 3Au+6CN^-$ (reduction of metal ions), and (2) $BH_3OH^-+3OH^-\rightarrow BO_2^-+3/2H_2+2H_2O+3e$ (oxidation of the reducing agent). The fundamental weakness of this chemical gold bath is that the system itself is a thermodynamically unstable system, a redox system, which tends to react in one direction, namely the direction of gold deposition. The goal is to maintain the system sufficiently stable while destabilizing the solution enough to assure acceptable deposition rates. This critical balance requires optimization of the system.

The equilibrium electrode potentials of the gold metal $E_{Au}$ ($Au^{n+}/Au$) and the reducing agent $E_R$ (DMAB/DMAB$^+$) may be obtained using the Nernst equation and the $E^0$ (standard oxidation-reduction potential) values. Both potentials depend on solution temperature, ionic concentrations, and the nature of the complexants used. The $E_R$ value is also strongly affected by the pH of the solution.

Many parameters—such as concentration, temperature, pH, and agitation—affect the performance of the electroless deposition system. The deposition rate increases with increase in temperature according to the Arrhenius rate law. The rate approximately doubles with a 10° C. rise in temperature. At temperatures higher than 85° C., however, the baths generally decompose rapidly. Thus, a temperature range of 60°–80° C. is recommended. The instability of baths at high temperatures can be used to recover gold from the used bath.

Agitation of the electroless plating bath affects deposition rate. The rate increases as the relative velocity of the bath increases up to a certain value. Beyond that value, increased agitation has little or no affect on deposition rate. Agitation also improves the quality of the deposit, eliminating nodule formation, providing lateral growth and uniform grain size, and decreasing porosity.

As a general characteristic, the rate of electroless gold deposition has a rather high value at the initial stages of the process and then rapidly decreases to a near steady value. The steady value is too slow to adapt existing electroless gold deposition baths for continuous production. The useful life of the baths at the operating temperature is limited to several hours.

A number of factors limit the bath life. Free cyanide ($CN^-$, resulting from decomposing $KAu(CN)_2$) and mataborate ions ($BO_2^-$) are formed during plating and accumulate in the solution while hydroxyl ions are consumed (by attachment of $OH^-$ ions to $BH_3$). Above certain accumulated amounts, both free cyanide and metaborate ions slow the deposition rate. For example, cyanide has a stabilizing effect in electroless gold plating baths which reduces the deposition rate. (A minimum amount of cyanide (several g/l) is required, however, to prevent spontaneous decomposition of the bath.) In addition, the gold is depleted from the plating bath as it is deposited on the substrate and the reducing agent (DMAB) is depleted by the gold deposition and by self-decomposition.

Gold content, the content of the reducing agent, and the $OH^-$ content can be corrected by replenishing the plating bath with a solution having the corresponding components. The present invention allows continuous operation of the cyanide-based electroless gold plating bath by replenishing the bath constituents using gold halide-hydroxide chemistry. A procedure is also established to accomplish replenishment. This enables repeated use of the bath chemistry, resulting in cost saving by conserving the chemicals used to make up the bath.

The present invention avoids undesirable excess cyanide build-up by generating (in situ) a gold halide-hydroxide mixed ligand complex of $Au^{3+}$ (or Au(III)). This is accomplished by the addition to the plating bath of a calculated amount of $Au^{3+}$ halide such as gold chloride, gold bromide, $HAuCl_4$ or $HAuBr_4$ (or their sodium, potassium, ammonium, or amine salts) in an alkali such as potassium hydroxide, sodium hydroxide, or ammonium hydroxide. The amount of $Au^{3+}$ halide to be added to the plating bath is calculated based on the amount of gold consumed from the plating bath (which is substantially equivalent to the amount of gold which must be replenished). For instance, in the examples provided below, 0.87 grams of hydrogen tetrachloroaurate replenishes 0.5 grams of gold in the plating bath and 3.47 grams of hydrogen tetrachloroaurate replenishes 2.0 grams of gold in the plating bath.

The solid gold halide salt (e.g., $HAuCl_4$) dissolves in the bath upon combination with $CN^-$ to form $Au^{3+}(CN)_2^-Cl^-OH^-$, thus consuming some of the free cyanide ions liberated in the deposition reaction of gold. The following three reactions summarize the replenishment process:

(1) $Au(CN)_2^- + e^- \rightarrow Au^0 + 2CN^-$ (heterogeneous reduction of $Au^+$ to $Au^0$ on the surface of a nickel substrate plated with gold);

(2) $CN^- + HAuCl_4 + OH^- \rightarrow Au^{3+}(CN^-)_2Cl^-OH^-$;

(3) $Au^{3+}(CN^-)_2Cl^-OH^- + (CH_3)_2NH \cdot BH_3 \rightarrow Au^+(CN)_2^-$ (homogeneous reduction of $Au^{3+}$ to $Au^+$ by DMAB).

The pH of the replenishment solution should be between 8 and 14 to prevent the bath from decomposing during addition and the optimum pH is 12. The concentration of the gold complex in the replenishing solution is kept below 0.25 g/ml to avoid hydrolysis by excess potassium hydroxide. Because this reaction is slow at room temperature, it does not pose any problem in actual practice. Nevertheless, long term storage of the replenishing solution in high concentrations is not recommended.

When the $Au^{3+}$ complex is added to the electroless gold bath in need of replenishment, the excess cyanide is complexed, initially to form a $Au^{3+}$ complex. This complex is reduced by the DMAB in the plating bath to form the $Au^+$ cyanide complex. It takes about 2 hours for this reaction to be completed, after which the pH and the concentrations of DMAB, free cyanide, and additives are adjusted to the original level to compensate for any loss due to drag out. The replenishment can be carried out at the bath operating temperature (typically 65° C.). To avoid any excessive formation of colloidal gold, however, it is preferable that the replenishment be done at 50° C. Filtration with a 0.5 μm filter element is highly recommended to remove any colloidal gold formed during the plating and replenishment operations.

Shown in FIG. 1 is a flow diagram 1 of the steps of the method in accordance with the invention of using the replenishing solution discussed above to replenish a cyanide-based electroless gold plating bath. The first step 10 is to provide a cyanide-based electroless gold plating bath having a source of gold including cyanide, a reducing agent, a stabilizer, and a pH adjuster which maintains the pH of the bath between 11 and 14. In the second step 20, gold is deposited on a substrate using the bath, thereby removing gold from the bath. Next, in third step 30, a replenishing solution is provided which includes a gold(III) halide and an alkali. The replenishing solution has a pH between 8 and 14. In fourth step 40, the amount of gold removed from the bath is determined. Finally, in fifth step 50, a sufficient amount of the replenishing solution is added to the bath to replace the gold removed from the bath during the depositing step without increasing the free cyanide concentration level in the bath above the initial level in the bath.

Additional, optional steps may be included in method 1. For example, a step 60 may be included in which the other components of the bath (such as the reducing agent, chelating agent, pH adjuster, and stabilizer) may be replenished, if needed, and the replenished bath is filtered to remove any colloidal gold formed during the plating and replenishment operations.

The efficacy of the present invention was demonstrated with an electroless gold plating bath comprising 4.4 g/l of potassium aurocyanide (3 grams of gold), 4 to 5 g/l of potassium cyanide, 5 g/l of DMAB, additives such as amines, and accelerators such as lead or thallium held at a pH of about 14 (by the addition of potassium hydroxide). The bath was used to plate properly prepared substrates so as to deposit between 0.5 and 2 grams of gold from 1 liter of bath. When the bath became low in gold content, it was replenished by a solution made up of hydrogen tetrachloroaurate ($HAuCl_4$) between 0.87 to 3.47 grams in water (25 ml) and the pH was adjusted with a solution of potassium hydroxide to a final solution pH of 12. After replenishment, the bath was agitated (moderate agitation) by pumping, and finally filtered before plating of new substrates was resumed. This replenishment process was repeated at appropriate intervals dictated by the amount of gold plated.

The actual bondability property required for ceramic packages and substrates prepared by the electroless gold plating solution as replenished according to the present invention was evaluated by MIL-STD 883 C. The results of that evaluation are summarized in the examples below. In short, the test samples prepared by the electroless gold plating solution as replenished according to the present invention satisfied the bondability required for semiconductor assembly.

EXAMPLE 1

An electroless gold bath with 4.4 g/l of potassium gold cyanide (equivalent to 3 grams of gold metal) was used to plate several substrates until the gold concentration in the bath dropped to 2.5 g/l To this bath was added a solution made by mixing hydrogen tetrachloroaurate (0.87 grams) and potassium hydroxide such that the final pH of the solution was 12. The plating bath was allowed to stir and, after filtration, was ready for plating additional substrates. A new set of substrates was plated in the replenished bath and the quality of the gold deposit from the replenished bath was tested using wire bond. The wire bond strength from new and replenished baths was found to be equivalent and to exceed the MIL-STD 883 C specification.

EXAMPLE 2

An electroless gold plating bath with an initial gold concentration of 3 g/l was used to plate coupons of nickel with a flash of immersion gold to deplete the gold concentration to 1.5 g/l. The average plating rate was found to be 1.7 μm/hour. This bath was replenished with a solution of hydrogen tetrachloroaurate (2.61 g/l) in 50 ml of water with potassium hydroxide used to adjust the pH to 13. After replenishment, the solution was stirred and filtered. A new set of nickel coupons with immersion gold was plated to again deplete the gold concentration to 1.5 g/l The average plating rate after replenishment was found to be 1.7 μm/hour. The above replenishment procedure was repeated 3 times. The average plating rate was found to be 1.7 μm/hour after every replenishment.

EXAMPLE 3

An electroless gold bath with 3 g/l of gold was used to plate a pin grid array substrate with a cavity for mounting a chip and a set of wire bond pads on the cavity shelves and several pins on the substrate surrounding the cavity. These substrates have a surface metallurgy consisting of nickel with immersion gold. A nominal gold thickness of 2 microns was plated. Representative substrates after plating were subjected to die attach and wire bond testing. The average wire bond strength with a 1 ml gold wire was found to be in the range of 13 to 15 grams and met the MIL-STD 883 C specification.

Several substrates were plated until the gold concentration in the bath was reduced to 2 g/l. The bath was replenished with 1.74 grams of hydrogen tetrachloroaurate and sufficient potassium hydroxide solution to adjust the pH of the replenishment solution to 14. The replenished bath was stirred and filtered, and several new substrates were plated to achieve a nominal 2 microns of gold. Tests of the die attach and wire bond were performed on the substrates plated from the replenished bath. The wire bond strength from the replenished bath was essentially in the same range of 13 to 15 grams and passed the MIL-STD 883 C specification.

EXAMPLE 4

Finally, the following experiment was performed to simulate a manufacturing process using the replenishing solution of the present invention. About 1 liter of the plating solution was used. The temperature was maintained between 60°–63° C, a relatively low bath temperature. The gold content was maintained at about 3 g/l. Moderate agitation was applied. The deposition speed was limited to about 2 μm/hour to achieve a balanced redox system. A higher deposition rate would increase the risk of random deposition of gold and might limit the life of the bath.

In Step 1, two 30 $cm^2$ coupons (providing a 60 $cm^2$ load) consisting of nickel with immersion gold (a nickel substrate with a thin gold plating) were plated for 1 hour at 60° C. using an electroless gold plating bath having 3 grams of gold per liter. The plating rate was 1.90 μm/hour. In Step 2, the same coupons were plated—at 2.20 μm/hour-for another 3 hours at a temperature of 63° C. (note that the increased temperature increased the plating rate). At this point, approximately ⅓ gold metal turnover was complete (i.e., about 1 of the initial 3 grams of gold in the original bath had been deposited).

In step 3, a replenishing solution was prepared. The solution had 25 ml of water with sufficient hydrogen tetrachloroaurate to bring the plating bath back up to 3 grams of gold and potassium hydroxide to control pH. About 25 ml of the original plating bath was also added to account for depleted buffer and drag out. Thus, a total replenishing solution of 50 ml was added to the bath.

In Step 4, the original two coupons (60 $cm^2$ load) were plated using the replenished bath. The coupons were plated for 5 hours at 62° C. The plating rate was 2.0 μm/hour for the first hour and 2.03 μm/hour for the remaining four hours. At this point, approximately ⅔ gold metal turnover was complete (i.e., about 2 of the initial 3 grams of gold in the original bath had been deposited).

In step 5, a second replenishing solution was prepared. The solution had 25 ml of water with sufficient hydrogen tetrachloroaurate to bring the plating bath back up to 3 grams of gold. About 25 ml of the original plating bath was also added. DMAB was titrated and added (about 10 ml of DMAB concentrate) to the replenishing solution. Thus, a total replenishing solution of about 60 ml was added to the bath.

In Step 6, the original two coupons (60 $cm^2$ load) were plated using the replenished bath. The coupons were plated for 1.25 hours at 62° C. The plating rate was 2.1 μm/hour.

In Step 7, the load was increased to 90 $cm^2$ by adding a third coupon (which, like the original coupons, was 30 $cm^2$). The plating bath was not replenished. The three coupons were plated for 4.75 hours at 62° C. The plating rate dropped to 1.75 μm/hour. At this point, one complete gold metal turnover was accomplished (i.e., all of the initial 3 grams of gold in the original bath had been deposited) and gold that had been replenished was also being deposited (note the longer plating time of 4.75 hours).

In Step 8, the three coupons (90 $cm^2$ load) were plated for 1 hour at 62° C. The plating rate dropped significantly to 1.0 μm/hour and a third replenishing solution was prepared. The solution had 25 ml of water with sufficient hydrogen tetrachloroaurate to bring the plating bath back up to 3 grams of gold. The pH was checked and found to be 13.2. Accordingly, potassium hydroxide was added to increase the pH to 13.9.

In Step 9, the three coupons (90 $cm^2$ load) were plated for 3 hours at 62° C. The plating rate returned to normal, 2.0 μm/hour, and the bath was stable. DMAB was titrated and found to be 6.0 g/l. The bath volume was checked and measured 900 ml (apparently, 100 ml had evaporated). Accordingly, 25 ml of water was added to bring the bath volume back to 1 liter. A fourth replenishing solution was prepared. The solution had 25 ml of water with sufficient hydrogen tetrachloroaurate to bring the plating bath back up to 3 grams of gold. At this point, approximately ⅔ of the second gold metal turnover was complete.

In Step 10, the load was increased to 120 $cm^2$ by adding a fourth coupon (which, like the other coupons, was 30 $cm^2$). The plating bath was not replenished. The four coupons were plated for 5 hours at 60° C. The plating rate dropped to 1.5 μm/hour. At this point, two complete gold metal turnovers were accomplished and the third turnover was started. DMAB was titrated and found to be 5.6 g/l. A fifth replenishing solution was prepared. The solution had 30 ml of water with sufficient hydrogen tetrachloroaurate to bring the plating bath back up to 3 grams of gold. An increased replenishment volume was added to compensate for the longer plating time of 5 hours.

In Step 11, three new coupons were plated having a combined load of 80 $cm^2$ (two 30 $cm^2$ coupons and one 20 $cm^2$ coupon). The coupons were plated for 3.25 hours at 60° C. The plating rate was 1.75 μm/hour. At this point, ⅓ of the third gold metal turnover was complete. The pH was measured as 13.6.

In step 12, a sixth replenishing solution was prepared. The solution had 25 ml of water with sufficient hydrogen tetrachloroaurate to bring the plating bath back up to 3 grams of gold. Potassium hydroxide was added to increase the pH to 13.9. DMAB was measured to be 5.3 gl The three coupons (80 $cm^2$ load) were then plated at 62° C. for 1.5 hours. The plating rate was 1.9 μm/hour. At this point, ½ of the third gold metal turnover was complete.

In Step 13, the three coupons (80 $cm^2$ load) were plated for 3.5 hours at 62° C. The plating rate was 1.4 μm/hour. Apparently, the coupons had been plated for too long without replenishing the plating bath. DMAB was added to the plating bath as 40 ml of concentrate. The DMAB was titrated and found to be 4 g/l.

In Step 14, the three coupons (80 $cm^2$ load) were plated for 2 hours at 62° C. The plating rate was 1.5 μm/hour. The gold and DMAB were replenished.

In Step 15, the three coupons (80 $cm^2$ load) were plated for 4.75 hours at 62° C. The plating rate was 1.8 μm/hour. Thus, the plating rate was largely restored and the plating process was active for almost 5 hours without replenishment. At this point, three complete gold metal turnovers were accomplished and the fourth turnover was started. Gold and potassium hydroxide were replenished.

In Step 16, the three coupons (80 $cm^2$ load) were plated for 1.75 hours at 62° C. The plating rate was 2.12 μm/hour. At this point, the experiment was abandoned as unequivocally successful. The conclusion was that the cyanide-based electroless gold plating bath could be replenished according to the present invention for a least three complete turnovers.

Figure 2:
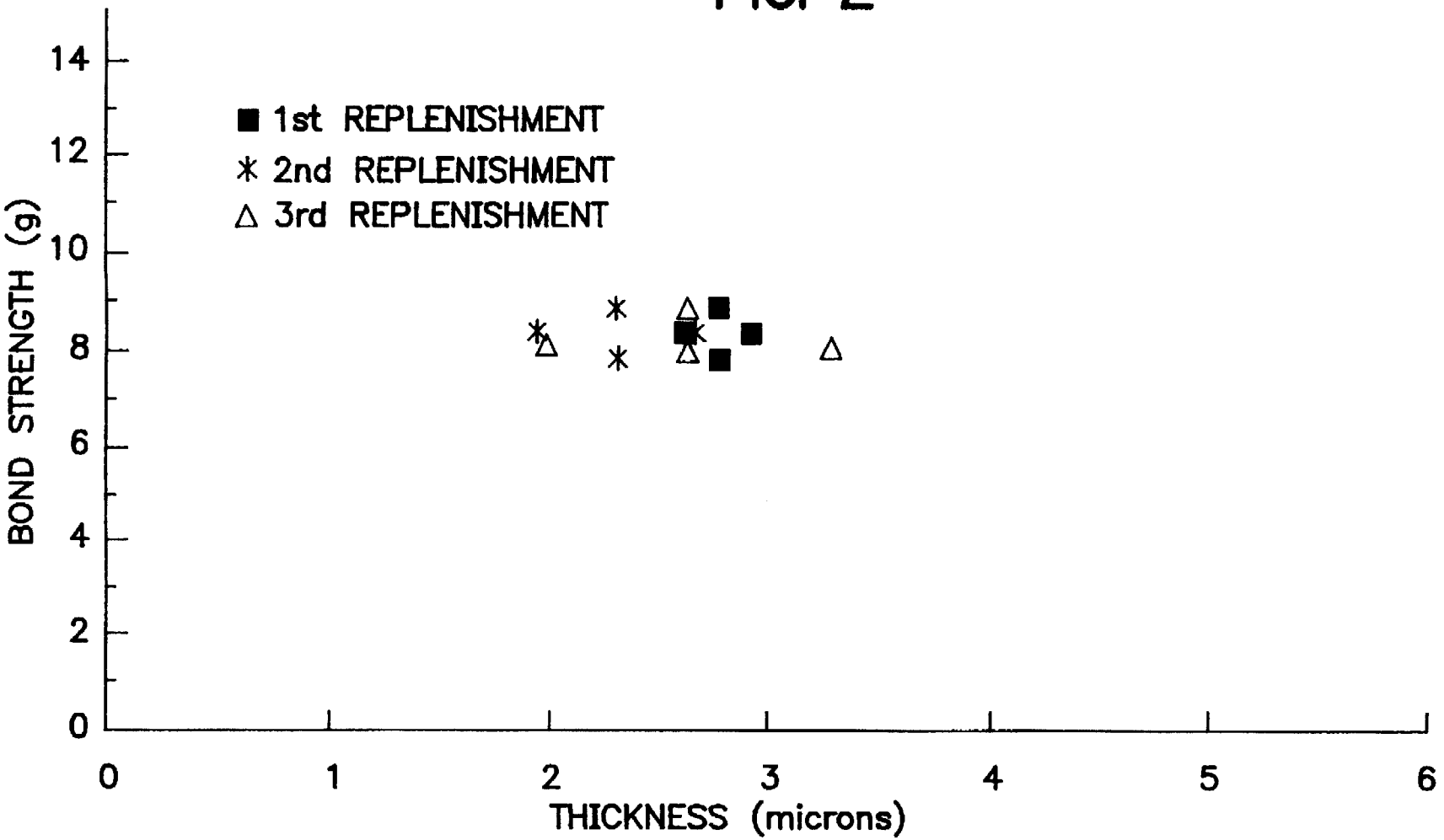
FIG. 2 is a graph of bond strength versus thickness for gold plated using a conventional electroless gold plating bath replenished with a solution according to the present invention.

Accordingly, it has been demonstrated that the $Au^{3+}$ chloride-hydroxide complex returns the plating bath to its initial state with respect to the plating rate and bath stability. Effects of repetitive replenishments (as would occur during manufacturing) on the performance of the bath—including the effects of chloride and nickel build-up on the bath stability, plating rate, and metallurgical quality of the deposited gold—were evaluated. The functional performance of the gold, as shown by bondability and plating rate (measured by thickness), are illustrated in FIG. 2.

Absent a successful gold replenishing procedure, the conventional electroless gold plating processes are too expensive for commercial use in manufacturing. The present invention renders such processes commercially viable for the first time.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A method of replenishing a cyanide-based electroless gold plating bath comprising the steps of:

providing a cyanide-based electroless gold plating bath having a source of gold including cyanide, a stabilizer, and pH adjuster which maintains the pH of the bath between 11 and 14;

depositing gold on a substrate using the bath, thereby removing gold from the bath;

providing a replenishing solution including a gold halide and an alkali hydroxide, which reacts with said cyanide to form a gold halide-hydroxide complex including said cyanide, said replenishing solution having a pH between 8 and 14;

determining the amount of gold removed from the bath; and adding a sufficient amount of the replenishing solution to the bath to replace the gold removed from the bath during the depositing step without increasing the free cyanide concentration level in the bath above the initial level in the bath.

2. A method according to claim 1 wherein said gold(III) halide is selected from the group consisting of gold chloride; gold bromide; tetrachloroaurate and its sodium, potassium, and ammonium salts; and tetrabromoaurate and its sodium, potassium, and ammonium salts.

3. A method according to claim 1 wherein said alkali is selected from the group consisting of potassium hydroxide, sodium hydroxide, and ammonium hydroxide.

4. A method according to claim 1 wherein said replenishing solution has a sufficient amount of said alkali to give the replenished bath a pH of about 12.

5. A method according to claim 1 wherein said step of depositing is done at a temperature of about 65° C.

6. A method according to claim 1 wherein said step of depositing is done while agitating the bath.

7. A method according to claim 6 wherein said step of adding the replenishing solution is done at a temperature of about 50° C.

8. A method according to claim 1 further comprising the step of filtering the replenished bath after the replenishing solution is added to the bath.

9. A method according to claim 1, wherein said replenishing solution further includes a reducing agent.

10. A method of replenishing a cyanide-based electroless gold plating bath comprising the steps of:

providing a cyanide-based electroless gold plating bath having a source of gold selected from the group consisting of potassium autocyanide and sodium aurocyanide, an amine borane reducing agent, a stabilizer selected from the group consisting of potassium cyanide and sodium cyanide, and a pH adjuster selected from the group consisting of sodium hydroxide and potassium hydroxide which maintains the pH of the bath between 11 and 14;

depositing gold on a substrate using the bath, thereby removing gold from the bath;

providing a replenishing solution including a gold (III) halide and an alkali hydroxide, which reacts with said cyanide to form a gold halide-hydroxide complex including said cyanide, wherein:

(a) said gold (III) halide is selected from the group consisting of gold chloride; gold bromide; tetrachloroaurate and its sodium, potassium, and ammonium salts; and tetrabromoaurate and its sodium, potassium, and ammonium salts, and (b) said alkali hydroxide is selected from the group consisting of potassium hydroxide, sodium hydroxide, and ammonium hydroxide, said replenishing solution having a pH between 8 and 14;

determining the mount of gold removed from the bath; and adding a sufficient amount of the replenishing solution to the bath to replace the gold removed from the bath during the depositing step without increasing the free cyanide concentration level in tile bath above the initial level in the bath.

11. A method according to claim 10 wherein said step of depositing is done at a temperature of about 65° C. while agitating the bath.

12. A method according to claim 10 wherein said step of adding the replenishing solution is done at a temperature of about 50° C.

13. A method according to claim 10 further comprising the step of filtering the replenished bath after the replenishing solution is added to the bath.

14. A method according to claim 10, wherein said replenishing solution further includes a reducing agent.

15. A method of replenishing a cyanide-based electroless gold plating bath comprising the steps of:

providing an electroless gold plating bath having potassium autocyanide, a dimethylaminoborane reducing agent, a potassium cyanide stabilizer, and a potassium hydroxide pH adjuster which maintains the pH of the bath between 11 and 14;

depositing gold on a substrate using the bath at a temperature of about 65° C., while agitating the bath thereby removing gold from the bath;

providing a replenishing solution comprising tetrachloroaurate and potassium hydroxide, wherein said replenishing solution has a pH between 8 and 14 and reacts with said cyanide to form a gold halide-hydroxide complex including said cyanide;

determining the amount of gold removed from the bath;

adding, at a temperature of about 50° C., a sufficient amount of the replenishing solution to tile bath to replace the gold removed from the bath during the deposition step without increasing the free cyanide concentration level in the bath above the initial level in the bath; and filtering the replenished bath.

16. A method according to claim 15, wherein said replenishing solution further includes a reducing agent.

* * * * *

UNITED STATES PATENT AND TRADE MARK OFFICE

CERTIFICATE OF CORRECTION

PATENT NO. : 5,635,253
DATED : June 3, 1997
INVENTOR(S) : Donald F. Canaperi et al.

It is certified that error appears in the above-identified patent and that said Letters Patent is hereby corrected as shown below:

Column 3, line 23, after "H." delete "All" and insert --Ali--.

Column 9, line 20, after "g/l" insert a period and a space.

Column 9, line 41, after "g/l" insert a period and a space.

Column 10, line 17, after "C" delete the period.

Column 10, line 21, after "C" delete the period.

Column 11, line 34, after "5.3" delete "gl" and insert --g/l.--.

Column 12, line 24, after "gold" insert --(III)--

Column 12, claim 10, line 65, delete "autocyanide" and insert --aurocyanide--.

UNITED STATES PATENT AND TRADE MARK OFFICE

CERTIFICATE OF CORRECTION

PATENT NO. : 5,635,253
DATED : June 3, 1997
INVENTOR(S) : Donald F. Canaperi et al.

It is certified that error appears in the above-identified patent and that said Letters Patent is hereby corrected as shown below:

Column 13, claim 10, line 21, change "mount" to --amount--.

Column 13, claim 10, line 24, change "tile" to --the--.

Column 13, claim 11, line 27, delete the period after "65 ° C".

Column 14, claim 15, line 9, change "autocyanide" to --aurocyanide--.

Column 14, claim 15, line 14, delete the period after --C--.

Column 14, claim 15, line 22, after "50° C" delete the period.

Column 14, claim 15, line 23, before "bath" delete "tile" and insert --the--.

Signed and Sealed this

Twenty-third Day of September, 1997

*Attest:*

Bruce Lehman

BRUCE LEHMAN

*Attesting Officer*

*Commissioner of Patents and Trademarks*